United States Patent [19]

Moutet et al.

[11] 3,931,374

[45] Jan. 6, 1976

[54] PROCESSES FOR THE MANUFACTURE OF FUEL BLOCKS CONTAINING A METALLIC POWDER AND IN THE CORRESPONDING BLOCKS

[75] Inventors: Helene Denise Moutet nee Layrisse, Massy; Maurice J. Pugibet, Paris; Jean-Jacques Scherchen, Yerres, all of France

[73] Assignee: Office National d'Etudes et de Recherches Aerospatiales (O.N.E.R.A.), Chatillon-sous-Bagneux, France

[22] Filed: Oct. 9, 1970

[21] Appl. No.: 79,689

[30] Foreign Application Priority Data

Oct. 13, 1969 France ..... 69.35024

[52] U.S. Cl. ..... 264/3 C; 149/7; 149/87; 149/114

[51] Int. Cl.[2] ..... C06B 21/00

[58] Field of Search ..... 149/6, 7, 87, 109, 20, 149/114, 44; 264/3 C

[56] References Cited

UNITED STATES PATENTS

| | | | |
|---|---|---|---|
| 3,203,171 | 8/1965 | Burke, Jr. et al. | 149/44 X |
| 3,257,801 | 6/1966 | Martinez | 149/37 X |
| 3,420,695 | 1/1969 | Rice et al. | 117/132 CF |
| 3,455,749 | 7/1969 | Gow | 149/6 X |
| 3,463,682 | 8/1969 | Hamrick | 149/20 X |
| 3,466,204 | 9/1969 | Gow | 149/7 X |
| 3,513,043 | 5/1970 | Burnside | 149/44 X |

*Primary Examiner*—Verlin R. Pendegrass
*Assistant Examiner*—Peter A. Nelson
*Attorney, Agent, or Firm*—Thomas E. Tate

[57] ABSTRACT

The fuel block contains an energizing metallic powder, each particle of which is surface coated with discrete particles of a polyfluoroethylene compound, preferably polytetrafluoroethylene, capable of reacting with the associated metal particle at a temperature below the combustion temperature of the block. The fuel block may be formed from hybrid propergols.

5 Claims, No Drawings

PROCESSES FOR THE MANUFACTURE OF FUEL BLOCKS CONTAINING A METALLIC POWDER AND IN THE CORRESPONDING BLOCKS

The invention relates to methods for the manufacture of fuel blocks of which the combustion performances are improved due to the fact that the said blocks contain (or even are essentially constituted by) light metal powders of high combustion temperature, such blocks being able to contain part at least of the oxidant, or assimilated component, necessary for their combustion (case of powders), or, on the contrary, have essentially a reducing character requiring for the combustion, the placing in the presence of the fuel block with another oxidising component or assimilated in the fluid phase, capable of reacting with the said fuel block under the conditions of use, which is the case of the hybrid propergols (said propergols causing the intervention of a component in the solid fuel phase and a component in the liquid oxidant phase) and, especially, hypergolic hybrid propergols, this latter category of hybrid propergols being characterised by the fact that the reaction between the two components (solid and fluid) of the propergol is initiated spontaneously through the fact alone of their co-introduction under the conditions of use.

The invention relate also to fuel blocks manufactured by such methods.

The invention relates more particularly, because it is in this case that its application seems to be most advantageous, but not exclusively, among these methods of manufacturing fuel blocks and among the corresponding fuel blocks, to those relating to fuel blocks for apparatuses for generating hot gases, especially for powder or hybrid rocket engines.

To simplify the description, whilst avoiding any ambiguity in the following, it will be convenient from this point to denote by the expression: "energising light metals" the metals or assimilated elements (with the exception of carbon of course) of the groups IA, IIA, IIIA and IVA of periods 2 and 3, and of groups IA and IIA of period 4, of the Mendelejeff table, that is to say lithium (Li), beryllium (Be), sodium (Na), magnesium (Mg), potassium (K), calcium (Ca), boron (B), aluminum (Al) and silicon (Si).

It is known that the incorporation, in a fuel block, especially in a block of an organic fuel burning with an oxidant), of a powder of an energising light metal, causes an improvement in the performances of combustion, the proportion by weight of this powder in the fuel having an optimal value which is a function, particularly, of the thermal characteristics of the energising light metal concerned.

It is easily understood that, to obtain the best performances of combustion with a fuel block containing, in an optimal proportion, a powder of an energising light metal, relative to which the base constituent of the block plays the role of binder, it is of prime importance that the particles of this powder burn completely (by reaction with the oxidant at the time when the said particles are liberated from their fuel binder) during the very brief time (of the order of $10^{-3}$ second), during which the above-said particles thus denuded still remain in the combustion chamber.

Among the causes capable of retarding combustion of the metallic particles incorporated in the organic fuel binder, there may be mentioned, particulary:

the relatively low temperature of the immediate surrounding medium, generally reducing;

the presence of a film of residue of binder capable of persisting at the surface of the particles for a certain time;

and the possible existence of a layer of oxide on the abovesaid particles on their incorporation in the organic fuel binder.

It will be seen, under these conditions, that it is advantageous to have means enabling the temperature of the metallic particles to be raised and to free them of the whole skin (or residue of binder or of oxide) forming an obstacle to the reaction of combustion of the abovesaid particles with the oxidant phase provided.

It is a particular object of the invention to provide such means and, consequently, to improve also the yield of combustion of the fuel blocks containing, even essentially constituted by, at least one energising light metal powder.

The method according to the invention provides for including in the fuel block, especially in a block based on an organic compound solid at ambient temperature and capable of burning by reaction with an oxidant (or assimilated component, such as a fluorine compound) a powder of at least one energising light metal, and it is characterised in that each particle of the said powder is coated superficially with a substance based on a halogenated compound of carbon (preferably a fluorine compound), capable, at a temperature distinctly below the combustion temperature of the fuel blocks in the oxidant provided, of reacting with the constituent metal or the particles (directly or by liberation of the halogen contained in this constituent) by an exothermic primary reaction having the effect, not only of raising the temperature of the abovesaid particles, but also of increasing the speef of vaporisation of the superficial residues possibly also contaminating the metallic particles, and of dissociating the possible skin of oxide previously formed on these particles, these three effects combining to reduce the time of initiation of the combustion reaction between the metallic particles and the principal oxidant, hence to improve the yield of combustion all things being otherwise equal.

In other words, the limited primary reaction intervening between the metallic particles and the coating substance ensures simultaneously a preheating of the said particles, hence a cleaning of their surface, this preheating and this cleaning accelerating the initiation of the reaction of the main combustion and improving the yield of the said combustion. However, to avoid the coating substance constituting a heat screen retarding the initiation of the reaction of the said substance with the metal of the particle, it is advantageous to observe certain precautions relating, especially, to the proportion of coating substance with respect to the mass of metallic particles, which proportion is, preferably, such that the characteristic ratio $\phi$ between the constituent metal of the particles of metallic powder and halogen introduced by the above-said coating substance, satisfies the double inequality $30 < \phi > 80$, the optimal value appearing in the neighbourhood of 40, and the structure of the layer of coating substance, which structure is, preferably, of "discrete" conformation, that is to say having, not the form of a continuous coating, but the form of a discontinuous network of spherules introduced in the form of a suspension of powder of the coating substance in a liquid.

The term "characteristic ratio" is well known in the art and is disclosed, for example, in "Rocket Propulsion" by Marcel Barrere, et al, chapter 3, published by Elsevier Publishing Company in 1960 and indexed in the Library of Congress under Catalog Card Number 59-8941. It should be understood to mean the stoichiometric equivalence ratio of fuel to oxidizer in the ultimately formed fuel block. It is this sense that the numerical value for the "mixture ratio" in each of the subsequent examples is used.

As regards then the powder of energising metal thus coated, its proportion by weight in the fuel block is, preferably, comprised between 20 and 40% and, preferably, about 30%, when the abovesaid fuel block is based on an organic compound solid at ambient temperature.

However, as already contemplated previously, the energising metal powder can constitute the essential material of the block in a propergol then preferably using water as oxidant, in which case the coating substance of the grains of metallic powder facilitates the agglomeration of the said grains on the manufacture of the block.

As for the granulometry of the abovesaid energising metallic powder, it is preferably selected so that the dimensions of the particles of powder (spherical or laminar) are comprised between 3 and 40 microns.

Taking into account this preferred granulometry of the energising metallic powder, and when the coating substance used is in the form of a suspension of spherules, the diameter of these spherules is preferably, comprised between 0.1 and 0.5 micron and, preferably, in the neighbourhood of 0.3 micron.

As regards then the method of incorporation in the organic fuel compound, which has to play the role of the basic constituent of the fuel block, of the energising light powder previously coated with the carbons halogenised substance, it is effected, preferably, at a temperature at which the abovesaid organic compound is liquefied, the abovesaid substance then being mixed with this compound in the form of a liquid phase.

Among the energising light metals mentioned, the most advantageous appear to be aluminum and beryllium of which the oxides are only eliminated at very high temperature, whilst their halides (formed on the reaction of the particles of these metals with the coating substance), especially their fluorides, are eliminated by sublimation at much lower temperatures.

Thus, at atmospheric pressure, aluminum oxide ($Al_2O_3$) is eliminated by fusion only at 2980°C, whilst aluminum fluoride sublimes from 1291°C, and beryllium oxide (BeO) is eliminated by fusion only at 2530°C, whilst beryllium fluoride sublimes at 800°C.

When the fuel block is based on a solid organic compound, the said compound is preferably an amine compound in the case of fuel blocks which have to come into action in a hybrid propergol, this amine compound being, preferably also, metatoluene diamine, associated with a support which is a polyamide (especially "Nylon") plasticised with cyclohexyl phthalate, this composition being called hereafter (NMTD).

In this case, that is to say in the case of a fuel block based on NMTD, the metallic particles are, preferably, coated by a substance belonging to a group of polyfluorethylenes, especially by polytetrafluorethylene (hereafter called PTFE), $C_2F_4$, which exists in commerce in the form of stable aqueous suspensions of colloidal spheres of PTFE, of a granulometry of the order of 0.1 to 0.4 micron, the commercial designation of this product being "SOREFLON 60", type 1 or type 3.

Deposition of the spheres of PTFE on the metallic particles can be effected, either directly on the said base particles before their incorporation in the amine compound, or in the midst of the said compound itself after incorporation of the metallic particles, the suspension of PTFE being miscible with a liquefied NMTD.

From the operational point of view, the procedure is advantageously as follows:

the amine compound is liquefied with stirring; the metallic powder, after having been mixed intimately with the coating substance, is introduced into the liquefied amine compound; the heating is carried on to a temperature ensuring elimination of water and precipitation of granules of the coating substance on the metallic particles; after which the mixture is poured into a mould and cooled until complete solidification.

To illustrate the preceding description, there will now be given three series of examples relating to fuel blocks for hybrid propergol, the chemical composition of the fuel block (and that of the corresponding oxidant) varying from one series of examples to the other.

FIRST SERIES OF EXAMPLES

For this first series of examples, the fuel block is based on NMTD 96/2/2 (96% of metatoluene diamine, 2% of polyamide and 2% of butyl phthalate) and it is enriched by aluminum powder, the oxidant contemplated being nitric acid ($HNO_3$).

The examples of this first series have the following operational characteristics:

a. NMTD 96/2/2 is brought to a temperature of 140°C with stirring until complete fusion;

b. during this time, the aluminum powder is mixed intimately with "SOREFLON 60" type 3, possibly with addition of water to obtain a slightly liquid paste, the relative proportions of the aluminum powder and of the SOREFLON 60 depending on the characteristic ratio of mixture desired;

c. the mixture prepared at the stage b is added gradually to the molten NMTD prepared in stage a and brought to a temperature of 105°C, water then being eliminated by boiling whilst the PTFE precipitates on the grains of aluminum;

d. the temperature of the product obtained is allowed to rise to 105°C, after which molding follows and cooling of the block.

Taking into account these data common to the examples of this series, the following are the particular data relating respectively to each of the said examples.

Example 1

Aluminum is spherical grains of an average granulometry of 5 microns: 28.25%, PTFE: 1.75%, NMTD: 70%.

The mixture ratio of $\phi$ of the block obtained is 45 and its combustion yield 96%.

Example 2

This example differs mainly from the preceding one in the proportions of aluminum and of PTFE which are respectively of 28.1% and of 1.9%.

The mixture ratio $\phi$ of the block obtained is 40 and its combustion yield 98.5%.

Example 3

This example differs from the preceding ones in the proportions of aluminum and of PTFE which are respectively 28.4% and 1.60%.

The mixture ration $\phi$ of the block obtained is 50 and its combustion yield 92%.

Example 4

Aluminum in flakes of 14 microns on the average: 28.1%, PTFE: 1.9%, NMTD: 70%.

The mixture ratio of $\phi$ of the block obtained is 40 and its combustion yield 99%.

Example 5

This example differs from the preceding example in the average dimension of aluminum flakes (44 microns) and in the proportions of aluminum and of PTFE which are respectively 28.7% and 1.3%.

The mixture ratio of $\phi$ of the block obtained is 60 and its combustion yield 98%.

SECOND SERIES OF EXAMPLES

For this second series of examples, the fuel block is based on polybutadiene and it is enriched by aluminum powder, the oxidant envisaged being hydrogen peroxide ($H_2O_2$) concentrated to the maximum of 98%.

The examples of this second series have the following common operational characteristics.

The technique of preparation differs from that described in the first series of examples, due to the fact that water cannot be eliminated in the midst of the fuel itself by reason of its insolubility and of the relatively low temperature appropriate for the cross-linking of the polybutadiene.

The aluminum coated with PTFE is prepared separately by mixing intimately aluminum powder and SOREFLON 60 type 3 with the addition, if necessary, of water which is then eliminated by evaporation at low temperature, possibly in vacuum.

The aluminum powder coated with PTFE is then dispersed mechanically and introduced, in suitable proportion for the obtaining of the characteristic mixture ratio desired $\phi$, in polybutadiene supplemented by cross-linking.

The mixture thus obtained is finally run into the mould and polymerised at a suitable temperature.

Example 6

The aluminum powder used is a powder with spherical grains of an average granulometry of 5 microns and the relative proportions of the constituents are 28.1% for aluminum, 1.6% for PTFE and 70.3% for polybutadiene.

The mixture ration $\phi$ of the block obtained is 40 and its combustion yield 98%.

Example 7

The aluminum powder used is a powder in flakes of 14 microns on the average and the relative proportions of the constituents are 28.1% for aluminum, 1.9% for PTFE and 70% for the polybutadiene.

The mixture ratio $\phi$ of the block obtained is 40 and its combustion yield 99%.

THIRD SERIES OF EXAMPLES

This third series of examples relates to the particular case where the fuel block is essentially constituted of energising light metal powder, in this instance, aluminum powder, the oxidant being water which, at high temperature, reacts in exothermic manner with the aluminum to give alumina and hydrogen by a process of continuous combustion.

The technique of preparing the aluminum powder coated with PTFE is the same as in the second series of examples but the proportions of aluminum and of PTFE are selected in a range corresponding to mixture ratios $\phi$ much lower (average value of $\phi$ of the order of 10 in this range).

The coated aluminum prepared as in the case of the second series of examples is then compressed to obtain fuel blocks whose cohesion is improved by the presence of the film of PTFE coating each grain of aluminum powder, such blocks being especially suitable for submarine propellants equipped with a suitable initiating device enabling the necessary temperature to be obtained for the combustion of the aluminum in the presence of water.

Example 8

The aluminum powder used is a spherical grain powder of average granulometry of 5 microns coated with PTFE in the following proportion: aluminum 78.26%, PTFE 21.74%.

The block is obtained by compression at 250 kg/mc$^2$.

The mixture ratio $\phi$ of the said block is 10 and its combustion yield 70%.

Example 9

The powder used is an alloy of aluminum (70%) and of magnesium (30%) with spherical grains of an average granulometry of 44 microns.

This alloy powder is coated with PTFE in the following proportion: alloy powder 77.07%, PTFE 22.93%.

The block is obtained by compression at 700 kg/cm$^2$.

The mixture ratio $\phi$ of the said block is 10 and its combustion yield 78%.

FOURTH SERIES OF EXAMPLES

These examples relate to fuel blocks for hybrid propellents enriched by beryllium powder.

Example 10

There is used as metallic powder a beryllium powder with spherical grains of 30 microns.

As in the first series of examples, the fuel block is based on NMTD and the techniques of coating and of incorporation of the metallic powder are the same.

The oxidant contemplated is nitric acid or nitrogen peroxide or a mixture of these two products.

The relative proportions of the constituents are the following:

| | |
|---|---|
| Beryllium | 27.45% |
| PTFE | 2.55% |
| NMTD 96/2/2 | 70% |

The mixture ratio $\phi$ of the block obtained is 60.

Example 11

There is used as metallic powder a beryllium powder with spherical grains of 20 microns. The fuel block is, as in the second series of examples, based on polybutadiene and the techniques of coating and of incorporation of the metallic powder are the same. The oxidant envisaged is 98% hydrogen peroxide. The relative proportions of the constituents are the following:

| | |
|---|---|
| Beryllium | 32% |
| PTFE | 3% |
| Polybutadiene | 65% |

The mixture ratio $\phi$ of the block obtained is 60 and the combustion yield greater than 90%.

FIFTH SERIES OF EXAMPLES

There will now be given two examples of compostions of fuel blocks containing the necessary oxidant for their combustion (powders). The coating and incorporation of the metallic powder in the binder are effected in the same way as in the second series of examples.

Example 12

| | |
|---|---|
| Ammonium perchlorate | 60% |
| Binder (polyurethane) | 20% |
| Aluminum powder (grains of 5 microns) | 18.83% |
| PTFE | 1.17% |

The mixture ratio $\phi$ is 60.

Example 13

| | |
|---|---|
| Ammonium perchlorate | 70% |
| Binder (polybutadiene) | 15% |
| Beryllium powder (grains of 20 microns) | 13.5% |
| PTFE | 1.5% |

The mixture ratio $\phi$ is 50.

As is self-evident and as emerges already besides from the preceding description, the invention is in no way limited to those of its methods of application nor to those of its methods of production of its various parts, which have been more particularly indicated; it embraces, on the contrary, all variations.

We claim:

1. In a method for the manufacture of a fuel block containing a powder of at least one energizing light metal selected from the group consisting of lithium, beryllium, sodium, magnesium, potassium, boron, aluminum and silicon, the steps of applying to the surface of each particle of said metallic powder a discontinuous coating comprised of discrete particles of a polyfluoroethylene compound, preparing a liquified mixture containing said coated metallic powder particles and an organic fuel compound which is normally solid at ambient temperature, and forming a dried fuel block from said mixture, said coated metallic powder particles comprising from 20 to 40% of the total weight of said dried fuel block.

2. The method of claim 1 in which said coated metallic powder comprises about 30% of the total weight of said dried fuel block.

3. Method according to claim 1, wherein the energising light metal powder previously coated with the coating substance is incorporated in the organic fuel compound at a temperature at which said compound is liquefied.

4. Method according to claim 1, wherein the organic fuel compound is an amine compound.

5. Method according to claim 4, wherein said amine compound is metatoluene diamine associated with a plasticised polyamide.

* * * * *